United States Patent [19]

Mansfield, Jr.

[11] 4,191,275

[45] Mar. 4, 1980

[54] SAFETY HARNESS KIT

[75] Inventor: Martin J. Mansfield, Jr., Philadelphia, Pa.

[73] Assignee: Cla-Mar International Corp., Philadelphia, Pa.

[21] Appl. No.: 949,334

[22] Filed: Oct. 6, 1978

[51] Int. Cl.[2] ..... A62B 1/16

[52] U.S. Cl. ..... 182/3

[58] Field of Search ..... 182/3, 4, 5, 6, 7, 8; 119/96; 244/151 R

[56] References Cited

U.S. PATENT DOCUMENTS

| | | | |
|---|---|---|---|
| 634,604 | 10/1899 | Asche | 182/3 |
| 1,738,581 | 12/1929 | Hodgson | 182/5 |
| 2,643,836 | 6/1953 | Carroll | 244/151 R |
| 2,647,293 | 8/1953 | Wintercorn | 182/6 |
| 2,699,284 | 1/1955 | Rose | 182/3 |
| 2,979,153 | 4/1961 | Hoagland | 182/3 |

*Primary Examiner*—Reinaldo P. Machado

*Attorney, Agent, or Firm*—Seidel, Gonda, Goldhammer & Panitch

[57] ABSTRACT

The safety harness kit, particularly for use in escape from a burning building, includes a harness, rope, a channel bar, and a hook. The harness is adaptable for use by adults and children and is made from stiff belting material.

9 Claims, 5 Drawing Figures

SAFETY HARNESS KIT

BACKGROUND

Fire prevention is the best means of fire protection. The best fire prevention will not stop a fire from starting, especially an electrical fire. Early detection of fire can be attained by an alarm. An alarm merely alerts one of the condition, namely that the building is on fire. It is still necessary to escape from the building. If one is trapped on a floor above ground level, escape through a window may be the only avenue of escape.

There is a need for a safety harness kit to facilitate escape through a window by one or more persons including children. The present invention is a solution to the problem and meets that need.

SUMMARY OF THE INVENTION

The safety harness kit of the present invention includes a safety harness for supporting a person from above by a rope. The harness includes an upper body strap having first and second ends. The strap is adapted to encircle a person's body below the arms. A discrete ring member is attached to each end portion of the upper body strap.

The harness also includes a lower body strap having first and second ends. The lower body strap is adapted to encircle an adult's body at the waist; or a child's body below the arms. A rear strap is connected to a middle portion of each of said body straps. A first front strap portion is connected to the first end of said body straps. A second front strap portion is connected to the second end of said body straps. At least one of said front strap portions is connected to said rear strap. A part of said front strap portions remote from said upper body strap are secured together in overlapping relation for supporting a person while being disposed between the person'legs. The straps and strap portions are made of stiff belting material.

The kit further includes a channel bar to facilitate paying out the rope from a window while lowering a person in the harness. The kit also includes a double point hook having a bight portion to facilitate escape of the last person from the room.

It is an object of the present invention to provide a novel safety harness kit which permits a plurality of adults and/or children to escape from a room above ground level in a burning building by way of a window.

It is another object of the present invention to provide a safety harness for suspending a person from above by way of a rope under any one of a wide variety of circumstances including escape from a burning building.

It is another object of the present invention to provide a safety harness kit which is simple, inexpensive and reliable.

Other objects will appear hereinafter.

For the purpose of illustrating the invention, there is shown in the drawings a form which is presently preferred; it being understood, however, that this invention is not limited to the precise arrangements and instrumentalities shown.

Figure 1:
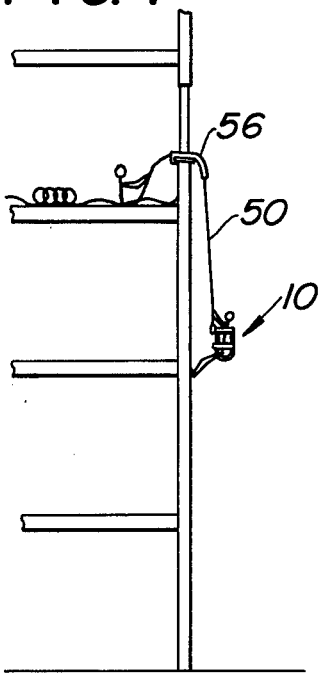
FIG. 1 is a diagrammatic illustration of a person escaping from a room above ground level in a burning building.
Figure 2:
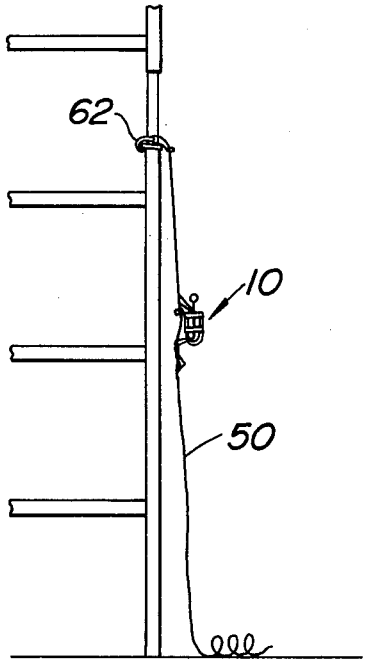
FIG. 2 is a view similar to FIG. 1 but showing escape of the last person from the room.
Figure 3:
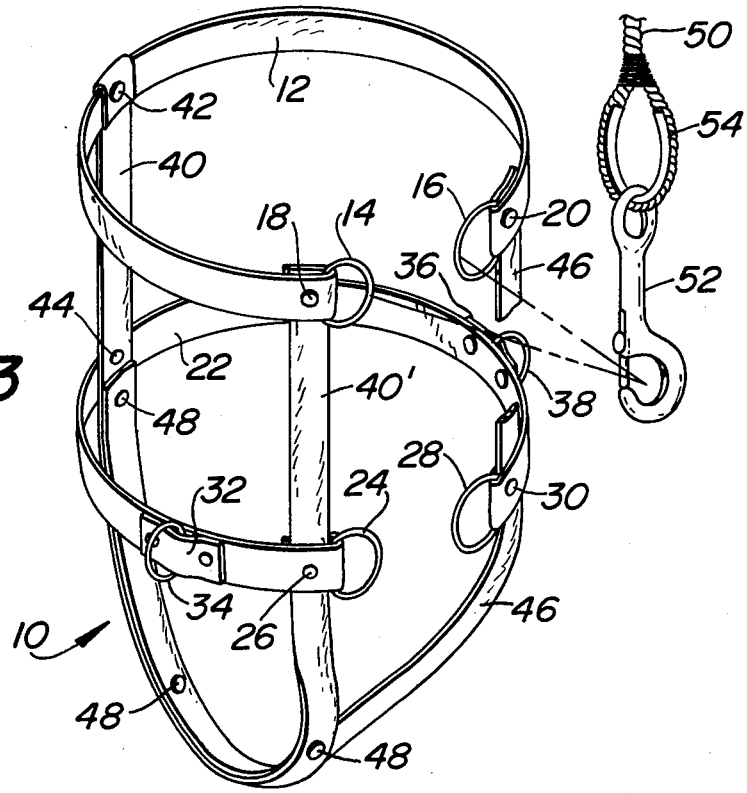
FIG. 3 is a perspective view of a harness in accordance with the present invention.

Referring to the drawings in detail, wherein like numerals indicate like elements, there is shown in FIG. 3 a harness in accordance with the present invention designated generally as 10. The harness 10 may be used for any type of rescue work but is particularly adapted for use in connection with escape from a room of a burning building as diagrammatically illustrated in FIGS. 1 and 2 and to be described in more detail hereinafter.

The harness 10 includes an upper body strap 12 having first and second free ends. A ring member 14 is secured to one end portion of strap 12 and ring member 16 is secured to the other end portion of strap 12. Ring member 14 is secured by bending a portion of the strap 12 back on itself and extending a fastener 18 through the overlapping portions. Ring 16 is similarly connected with a fastener 20 extending through the overlapping portions.

A lower body strap 22 is provided with first and second ends and is below while being generally parallel to the upper body strap 12. The upper and lower body straps 12 are approximately the same length namely, about 40 to 42 inches. A ring member 24 is secured to the lower body strap 22 adjacent the end thereof by way of fastener 26. A ring member 28 is connected to the end portion of strap 22 by way of fastener 30. As described above, each of the fasteners 26, 30 extends through a double thickness of the lower body strap 22.

A short strap 32, having a length of about 3 inches is secured by fasteners to the lower strap 22 adjacent one end portion. A ring member 34 is thusly secured to the lower strap member 22 approximately 6 inches from the free end thereof. Another ring member 38 is secured to the strap member 22 by way of a short strap 36 in a similar manner.

An end portion of a rear strap 40 is secured to a middle portion of the upper body strap 12 by way of a fastener 42. Rear strap 40 is also connected to the lower body strap 22 by a fastener 44. In the preferred embodiment of the invention, rear strap 40 is of sufficient length so as to have a loop below the lower body strap 22 and then has an upwardly extending front strap portion 40'. Portion 40' is joined to the upper body strap 12 by the fastener 18 and is joined to the lower body strap 22 by fastener 26. If desired, the rear strap 40 and the front strap portion 40' could be two separate straps secured end to end.

a front strap portion 46 has one end connected to the upper body strap by the fastener 20. An intermediate part of the front strap portion 46 is secured to the lower body strap 22 by the fastener 30. From the lower body strap 22, the front strap portion 46 extends as a loop downwardly to and overlaps the upper surface of the front strap portion 40'. The overlapping portions 40' and 46 are fixedly secured by fasteners 48.

All of the body straps and strap portions are preferably made from a stiff belting material such as leather belting 8/9 ounce 1½ inches wide and 3/16 inches thick. All of the fasteners described above are preferably metal rivets. The ring members described above are preferably of the type known as D-rings since such ring members are D-shaped with the straight portion thereof in the loop between the layers of belting.

The harness 10 is of a type which is open at the front so that it is easily stepped into. The harness 10 when being worn will have the upper body strap 12 below the arms of the adult with the lower body strap 22 adjacent the adult's waist, and with the overlapped layers of the front strap portions 40', 46 between the person's legs. The harness 10 accommodates persons of different sizes including adults and children. The person wearing the harness 10 will be suspended from above by way of a rope 50. The rope 50 preferably has an adjustable clamp 52 of the slide bolt type attached to a spliced end 54 of rope 50. When the harness 10 is being worn by an average size adult, it is connected to the rope 50 in the following manner. The clamp 52 is attached to the ring members 14 and 16. When harness 10 is being worn by a larger adult, the clamp 52 is slipped through the ring member 14 and 16 and then its hook portion, of clamp 52, is attached to the rope 50 above the spliced end 54, thus expanding the harness to a larger chest. For a large child, the rope 50 is attached to the harness by attaching clamp 52 directly to ring members 24, 28. For a small child, the harness 10 is connected to the rope 50 by attaching clamp 52 directly to ring members 34, 38. Since the harness 10 is open in the front, it is easy to step into. There are no components of the harness which must be separately attached to one another since it is desired that the harness be capable of being used in darkness with maximum speed.

To facilitate use of the harness 10 in connection with escape from a window of a room above ground level, there is provided in the kit of the present invention, a channel bar 56. See FIG. 4. Channel bar 56 may be made from a wide variety of different materials but preferably is ASTM grade A36 structural carbon steel having a thickness of $\frac{1}{8}$ inch. The channel bar 56 is channel-shaped in cross-section and has two straight end portions connected by a curved portion. One of the end portions has a hook 58 fixedly secured thereto in any convenient manner such as by welding. The hook 58 is adapted to extend under the windowsill within the room so that the channel bar 56 may be used as a guide for the rope 50 and thereby minimize contact between the rope 50 and the windowsill.

The channel bar 56 prevent damage to the rope which would occur if the rope 50 contacted storm window frames, brick or mortar. I have found that channel bar 56 may have a total length of 21–23 inches and an included angle betweeen its straight portions of 100° whereby it may be used with almost any design of a windowsill whether the building is made of wood, brick, stone, etc.

The kit of the present invention also includes a double point hook 60 having a bight portion 62 and a pair of downwardly extending hooks. The hook 60 is preferably $\frac{5}{8}$ inch diameter hot rolled steel and is generally V-shaped in plan view.

The kit of the present invention is utilized as follows. The first person to be lowered to ground level steps into the harness. Rope 50 is attached to one of the sets of ring members as described above. The channel bar 56 is placed over the windowsill on either end thereof. The person wearing the harness crawls through the window feet first and hangs onto the windowsill until the other person remaining in the room is ready to commence lowering the rope.

The rope 50 is trained within the channel bar 56 and held by the other person remaining in the room who should be sitting on the uncoiled rope on the floor with his feet extending to the wall. At a given signal by one of the persons, the person remaining within the room pays out the rope 50 hand under hand thereby lowering the person wearing the harness 10. As soon as the person wearing the harness 10 reaches ground level, he merely steps out of the harness 10. That is, there are no straps or buckles to manipulate. Thereafter, the harness is pulled upwardly to the room so that the next person may escape in a similar manner.

Figures 4, 5:
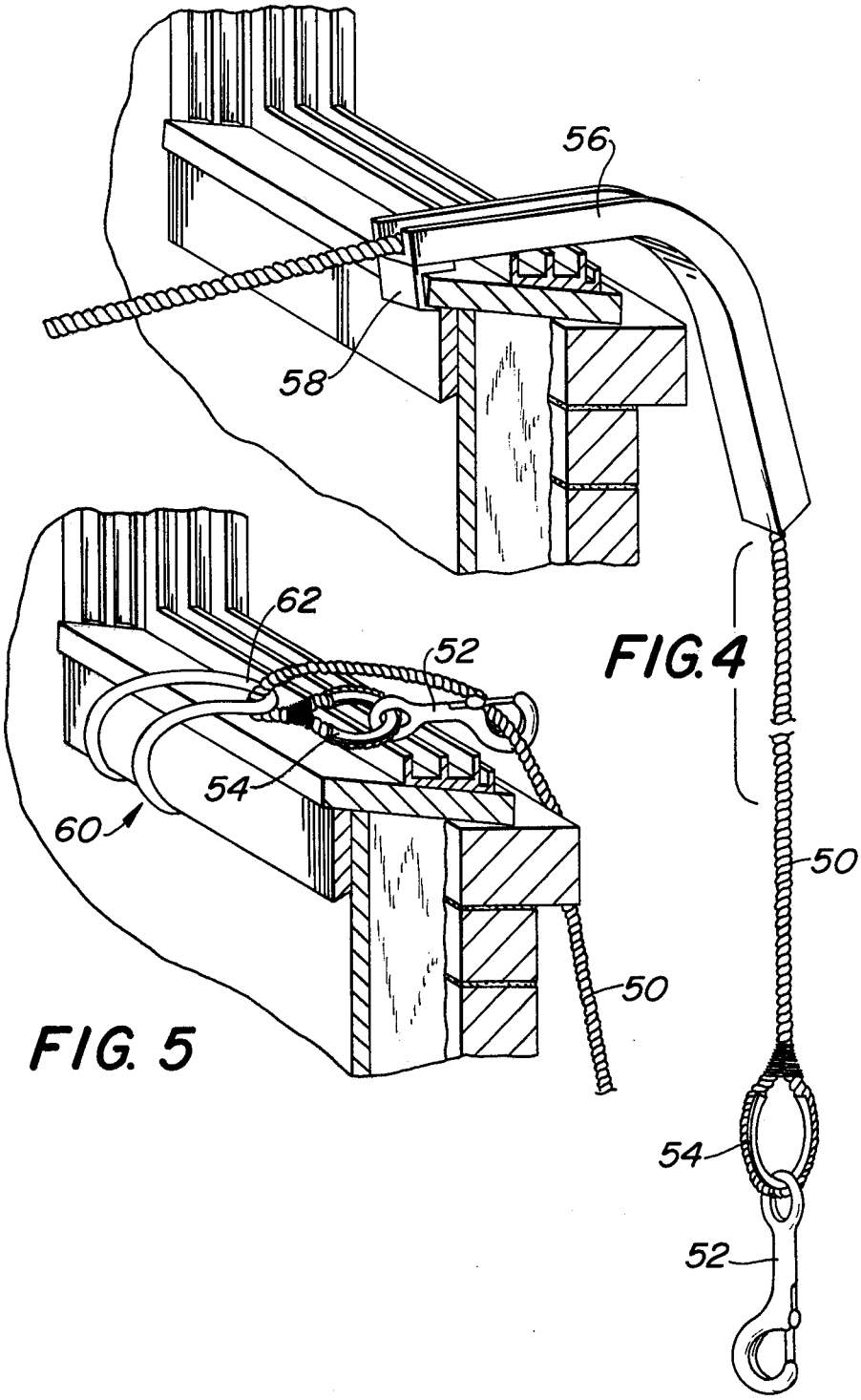
FIG. 4 is a perspective view of a channel bar mounted on a windowsill.
FIG. 5 is a perspective view of the double point hook mounted on a windowsill.

The last person to escape removes the channel bar 56 and applies the hook 60 adjacent one end of the windowsill as shown in FIG. 5. The last person escaping, after having placed the harness on their body, passes the clamp 52 and rope 50 through the ring members 14 and 16 twice, making sure the second pass is above the first. After this procedure, the person pulls approximately two feet of rope and forms a loop with the end of the rope by attaching clamp 52 to an unspliced section of rope 50 above spliced end 54. The rope is trained through bight portion 62 and placed on the windowsill. The free end of rope 50 is thrown to ground level. While sitting on the windowsill and legs extended outside, the person wraps a free end of rope 50 around his right leg once between knee and ankle, and then position rope 50 under his right foot, in the middle thereof. The left foot is used to catch and position rope 50 under his right foot, securing rope 50 between crossed feet and ankles.

He then turns his body around and suspends himself outside the window by grasping onto the rope 50 with both hands. Using hand under hand method and pressure created on rope 50 with his feet and ankles, he lowers his body to ground level by sliding down rope 50. Speed can be dictated by rope sliding between feet (see FIG. 2). Should the last person coming down lose control of rope 50 around his legs and feet, a person on the ground could help alleviate their weight and slow this descent, by pulling down on rope 50 thereby exerting pressure on rope 50 attached to ring members 14 and 16 on the harness 10. This above procedure can suspend a person in midair.

The above description assumes that there is more than one person who must escape from the room. If there is only one person who must escape from the room, the channel bar 56 is not used. The person uses the hook 60 as described above and holds onto the free end portion of the rope sliding down rope as previously described.

The present invention may be embodied in other specific forms without departing from the spirit or essential attributes thereof and, accordingly, reference should be made to the appended claims, rather than to the foregoing specification, as indicating the scope of the invention.

I claim:

1. A safety harness for suspending a person from above by a rope comprising:

(a) an upper body strap having first and second ends, said strap being adapted to encircle a person's body below the arms, a discrete ring member attached to each end portion of said strap, (b) a lower body strap beneath said upper body strap, said lower body strap having first and second ends and being adapted to encircle an adult's waist or a child's body under the arms, a discrete ring member attached to each end portion of said lower body strap, (c) a rear strap connected to a middle portion of each of said body straps, (d) a first front strap portion connected to each of said body straps adjacent their first ends, a second front strap portion connected to each of said body straps adjacent their second ends, and part of said front strap portions remote from said upper body strap being secured together in overlapping relation for supporting a person by being disposed between the person's legs, and the harness being open between said front strap portions.

2. A harness in accordance with claim 1 wherein said straps are made from a stiff belting material.

3. A harness in accordance with claim 1 including a discrete ring member attached to each end portion of said lower body strap.

4. A harness in accordance with claim 3 including an additional discrete ring member attached to said lower body strap on opposite sides of said rear strap.

5. A harness in accordance with claim 1 wherein one of said front strap portions is integral in one piece with said rear strap.

6. A safety harness kit including a safety harness in accordance with claim 1, a channel bar made of metal with a hook at one end, a rope having an adjustable clamp at one end, and a windowsill engageable hook which is U-shaped or V-shaped in plan view so as to have a bight portion.

7. A kit in accordance with claim 6 wherein said adjustable clamp attached to one end of said rope is of sufficient size so as to pass through said ring members.

8. A safety harness for suspending a person from above by a rope comprising:

(a) said harness having an open unobstructed top and an open unobstructed elongated opening at its front, (b) an upper body strap having first and second ends and being adapted to encircle a person's body below the arms, a discrete metal ring member attached between overlapping end portions at each of said first and second ends of said strap, (c) a lower body strap below and generally parallel to said upper body strap, said lower body strap being adapted to encircle an adult's waist or encircle a child's body under the arms, a discrete ring member attached between overlapping end portions of each of first and second ends on said lower body strap, (d) a rear strap connected to a middle portion of each of said body straps so as to extend generally vertically along the back of a person wearing the harness, (e) a first front strap portion defining one side of said open front of said harness, said first front strap portion being connected to one end portion of each of said body straps, a second front strap portion defining the other side of said front opening, said second front strap portion being connected to the other end portion of each of said body straps, each ring member being adjacent the connection between said body straps and said front strap portions, (f) part of said front strap portions below the elevation of said lower body strap being overlapped and at least one front strap portion being connected to said rear strap, said overlapped portions cooperating with said lower body strap to define two leg openings through which a person's legs may extend.

9. a harness in accordance with claim 8 wherein said rear strap is integral in one piece with one of said front strap portions.

* * * * *